United States Patent [19]

Takada

[11] 4,060,879

[45] Dec. 6, 1977

[54] SEAT BELT BUCKLE

[75] Inventor: Juichiro Takada, Tokyo, Japan

[73] Assignee: Takata Kojyo Co., Ltd, Tokyo, Japan

[21] Appl. No.: 714,544

[22] Filed: Aug. 16, 1976

[30] Foreign Application Priority Data

Aug. 19, 1975 Japan ..... 50-99817

[51] Int. Cl.[2] ..... A44B 11/26

[52] U.S. Cl. ..... 24/230 A

[58] Field of Search ..... 24/230 AL; 24/230 A

[56] References Cited

U.S. PATENT DOCUMENTS

| | | | |
|---|---|---|---|
| 3,807,000 | 4/1974 | Weman | 24/230 AL |
| 3,851,360 | 12/1974 | Minolla | 24/230 AL |
| 3,877,115 | 4/1975 | Stoffel | 24/230 AL |

*Primary Examiner*—Bernard A. Gelak
*Attorney, Agent, or Firm*—Wolder & Gross

[57] ABSTRACT

A safety belt buckle includes a body member having a tongue receiving front opening and houses a floating latching member which is swingable about a transverse axis between lock and unlock positions engaging and disengaging an inserted coupling tongue, a push member is accessible through a window in the body member top wall and when depressed swings the latch member to unlock position to release the tongue. A unitary multifunctional spring member is located in the body member and includes guide and spring elements resiliently biasing the latching member to a medial forward locked position and a spring element resiliently biasing an inserted coupling tongue forwardly so as to eject the coupling tongue when it is unlocked or when it is improperly or insecurely coupled. The spring member likewise floats and includes a base plate overlying the body member base and side positioning flanges engaging the body member side walls.

9 Claims, 8 Drawing Figures

SEAT BELT BUCKLE

BACKGROUND OF THE INVENTION

The present invention relates generally to improvements in seat belt buckles and it relates to an improved buckle having minimal parts and that can be selectively released with mimimal effort.

Conventionally, buckles are extensively used to couple and uncouple seat safety belts. Such buckles of the push type, however, consist of many parts requiring an awkward assembling operation to thereby prevent a false latching that is a condition in which the buckle appears to be properly latched but is not, and that occurs when the tongue piece is inserted with insufficient force. With such buckles, since the release from the tongue-engaging part is effected by the motion of a spring that moves up and down, the lever ratio or the pushing force from the pressure part is not sufficient. Further, efforts to improve the pressing force and eliminate aforesaid false latching, have resulted in an excessively increased number of parts, making for a complicated construction.

SUMMARY OF THE INVENTION

Accordingly, it is a principal object of the present invention to provide a safety belt buckle by which false latching is prevented with a simple construction having a minimal number of parts, and by which the force exerted on the buckle can be effectively handled and distributed to a maximum degree thereby making it easy to release and couple the tongue piece, without obviating the function of the earlier buckles.

In the buckle of the present invention, there is provided a frame which is curved in cross section to form a channel, the bottom web thereof having a raised forward tongue piece-engaging part, a latch plate having a pressure-receiving part at its upper end and is so hook shaped that both ends of the curved portion are loosely engaged at determined positions of the frame and a multifunction spring member formed of a piece of thin and resilient plate having many finger and projections is inserted between the latch plate and the frame base plate so that the latch plate is resiliently urged in many directions such as forward, upward and inward directions and a push part is formed on the upper surface of the latch plate.

Details of the present invention are hereinafter described with reference to the accompanying drawings. It should be noted that the present invention is not limited to the specific structures in the accompanying drawings only, but that various design modifications may be made within a range that does not depart from the objects and scope of the present invention.

DESCRIPTION OF THE PREFERRED EMBODIMENTS

Figure 1:
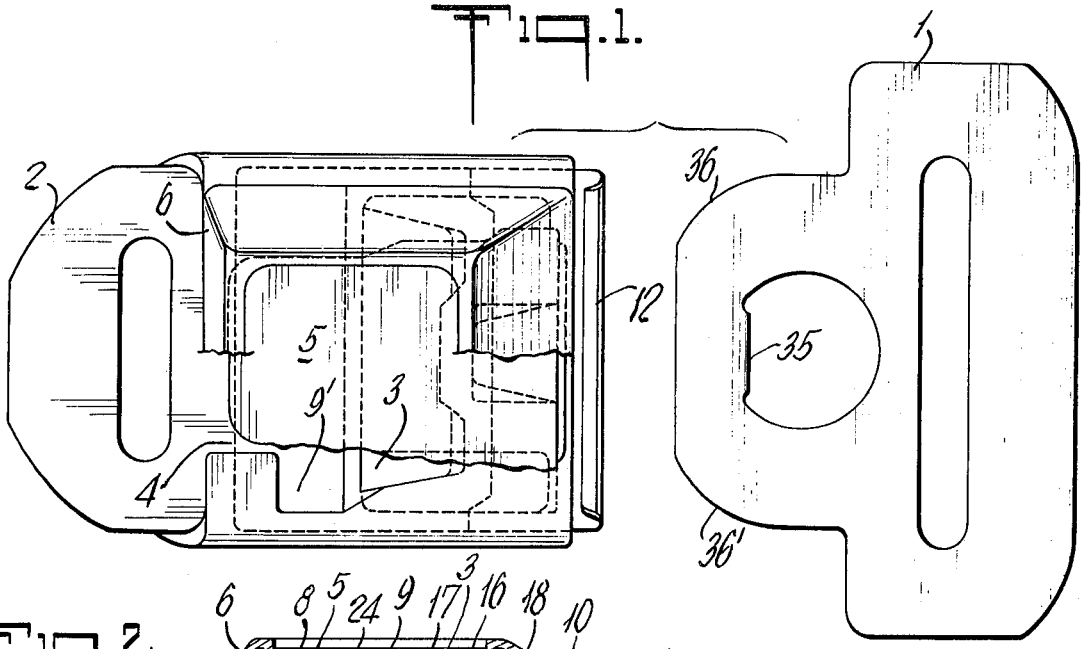
FIG. 1 is a fragmentary top plan view of a preferred embodiment of the present invention showing the tongue and buckle in uncoupled condition.
Figure 2:
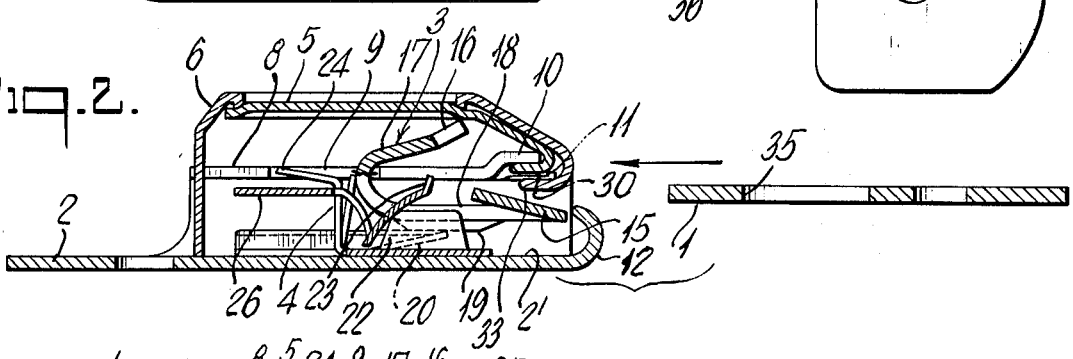
FIG. 2 is a medial longitudinal cross sectional view thereof.

Referring now to the drawings, particularly FIGS. 1 to 5 thereof which illustrate a preferred embodiment of the present invention, the reference numeral 1 generally designates a tongue piece that can be engaged or disengaged with the buckle body consisting of frame 2, a latch plate or member 3, a multi-function spring member 4 formed of a piece of thin resilient metal plate, and an actuator or push plate or member 5. The frame 2 has opposed side walls 7, 7' that are directed upwardly from both sides of the base plate 2', and the upper surface thereof is further bent inwardly to form inwardly directed flanges 8, 8'. The frame bottom wall or base plate 2' has a front curved border or section 12 that is curved upwardly directed thereby delineating the lower transverse edge of a tongue piece-insertion hole 13 whose upper edge is delineated by the flanges 8, 8' and the side edges by side walls 7, 7'. The flanges 8, 8' further have pairs of opposite protruding engaging parts or fingers 10, 10', 11, 11' on the upper sides of the tongue piece insertion hole 13 as shown, and further have notches 9, 9' at the center or a little back of the central position to engage the multi-function spring 4 and to hold the latch plate 5. The protruded engaging parts 10, 10', 11, 11' serve to engage the push plate 5 and a cover 6 that will be hereinafter described. Although the drawings show these each in pairs, the structure need not be so limited, but may be modified appropriately to attain the object of the present invention. The reference numeral 14 designates a connection opening to which a belt or strap may be fastened and which may have any suitable shape, and can be connected, for example, to the floor or seat of the vehicle by way of a flexible member.

The latch plate 3 is made of a plate which is curved in cross section to form a hook, and has a knee or curved area 17 that can be resiliently bent to a determined degree when latched to the walls on the side of the tongue piece insertion of the notches 9, 9' of the frame 2, so that the latch plate 3 can be smoothly held. Further, on the bottom surface representing the long side of the hook-shaped cross section are formed an upwardly projecting tongue piece-engaging part 15 having a rearwardly facing shoulder, a spring hole 18 and depending ridges or bead parts 19, 19' forming surfaces to receive the pressure of the springs 20, 20' as will be hereinafter explained, thereby reinforcing the latch plate 3 as shown. On the upper end of the tip of the hook, on opposite sides thereof, are formed upwardly pressure receiving fingers or parts 16, 16'. The bead parts 19, 19' and the pressure receiving parts 16, 16' need not be limited to the construction shown in the drawings; the bead parts 19, 19' may be formed in any construction if they have the strength and surfaces to which will be applied the pressure of the springs 20, 20', and also the pressure receiving parts 16, 16' may be formed in any construction if they can receive the pressure imparted thereto by the push plate 5. The multi-function spring 4 is a spring board or unit and is one of the features of the present invention. The multi-function spring 4 is made of a piece of thin resilient metal plate and is bent in a stepped manner, having on the base or lower side thereof, finger springs 20, 20' on both sides to upwardly bias or urge the latch plate 3, and having at the middle part transversely spaced vertical fingers or side walls 22, 22' to resiliently support both sides of the spring hole 18 of the latch plate 3 and to permit the smooth introduction of the tongue piece when the tongue piece is being inserted. The lower side edges of the multi-function spring member 4, form upper side walls or lips 25, 25' to resiliently press the spring member 4 to the side walls 7, 7' of the frame 2. Also, on both sides on the upper side of the spring member 4 are formed upwardly inclined finger springs 24, 24' that serve to fasten the spring 4 to the notched parts 9, 9' of the frame 2. At the vertical wall linking the upper and lower portion of the spring member 4 are formed finger springs 21, 21' that bias or always press the latch plate 3 forward, and at the middle part is provided a tongue piece ejecting spring 23 that ejects the tongue piece 1 when a false latch is likely to be developed and when the tongue piece 1 is to be released from the buckle body. The reference numeral 26 designates the spring member upper part that will be angularly pressed from the upper direction in order that the spring member 4 may be easily inserted between the aforesaid frame base plate 2' and the bottom surface of the latch plate 3 when the buckle is being assembled, the reference numerals 27, 27' being holes that serve to ensure the smooth functioning of the tongue piece ejecting spring 23, and the reference numeral 28 designates an opening in the tongue piece ejecting spring 23 and is suited for the passage of the arm of a switch that may be mounted on the buckle.

The push plate 5 engages and follows the upper surface of the latch plate 3 and serves to transmit the selective pressing force to the latch plate by way of the pressure receiving parts 16, 16'. The push plate 5 has a pushing part 29, and its extended end is curved and rockably engages with the engaging parts 10, 10' of the frame 2 by way of its curved lip or support point 30. The reference numeral 6 designates a cover or top wall that overlies the push plate 5 and is connected to the engaging parts 11, 11' of the frame 2 by way of its curved engaging part 33, and has a window 32 on its upper surface through which is exposed an accessible pushing part 29. The cover 6 is reliably secured by means of a covering engaging notch 34 that is provided at the end opposite to said curved engaging part 33. The reference numeral 35 is an engaging part of the tongue piece 1, and the numerals 36, 36' designate inclined or cam surfaces on the insertion side of the tongue piece.

The lower portion of the latch plate 3 is inserted through the notched parts 9, 9' with the pressure receiving parts 16, 16' of the latch plate 3 protruding beyond the notched parts 9, 9' of the frame 2, and the curved portion 17 of the latch plate 3 is brought into contact with, and supported by the side walls on the side of tongue piece insertion of the notched parts 9, 9', and the lower portion of the spring plate 4 is inserted between the frame base plate 2' and the overlying lower portion of the latch plate 3 from the side opposite to the tongue piece insertion side, and then the part 26 on the upper part of the spring plate 4 is pressed and inserted. At this time, the engaging springs 24, 24' on the upper and on both sides are engaging the notched parts 9, 9' of the frame 2, and the biasing springs 20, 20' on the lower portion are positioned on the lower side of the bead parts 19, 19' of the latch plate 3, whereby the side walls 22, 22' of the latch plate are positioned at the spring opening 18 which is located rearwardly of the tongue piece engaging part 15. The pushing or actuating plate 5 is then held by engaging the curved support section section 30 with the engaging parts 10, 10' of the frame 2, and over the upper part thereof is mounted the cover 6 with its curved engaging part 33 engaging finger part 11 of the frame 2. The cover fastening notch 34 is then engaged with the rear ends of the flanges 8, 8' of the frame 2 to thereby complete the assembly of the buckle.

Figure 4:
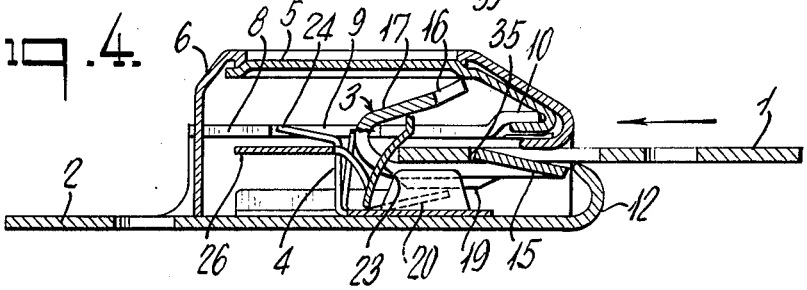
FIG. 4 is a view similar to FIG. 2 showing the buckle and tongue in coupled condition.
Figure 5:
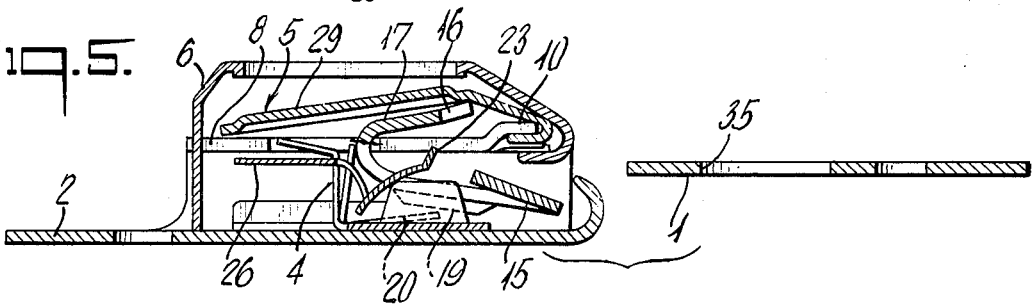
FIG. 5 is a view similar to FIG. 4 showing the buckle in an unlocked condition.

In order to couple the tongue piece 1 to the assembled buckle, the tongue piece is inserted whereby the lower portion of the latch plate 3 is pressed by the spring and the shoulder or engaging part 35 of the tongue piece is engaged by the tongue piece engaging part 15 of the latch plate 3 as shown in FIG. 4; the force of the spring is then released and the tongue piece is locked or fastened. The state of incomplete insertion may occasionally happen if the force of inserting the tongue piece 1 is very small or if the insertion of the tongue piece 1 is halted before it is completely inserted. However, with the buckle of the present invention, the incompletely inserted tongue piece will be repelled by the tongue piece ejecting spring 23 that is provided as a part of the multi-function spring member 4 and the aforementioned false latching will never occur. To disengage the tongue piece 1 from the buckle, the pushing part 29, as shown in FIG. 5, is pushed to press the pressure receiving parts 16, 16' of the latch plate 3 downward. The lower portion of the latch plate is moved against the biasing spring with the curved section 17 of the latch plate 3 as a fulcrum, and the engagement between the tongue piece engaging part 15 and the engaging part 35 of the tongue piece is released, and at the same time, the tongue piece 1 is released immediately by the resilient force of the tongue piece ejecting spring 23 which resiliently bears against the tip of the tongue piece 1.

Figure 8:
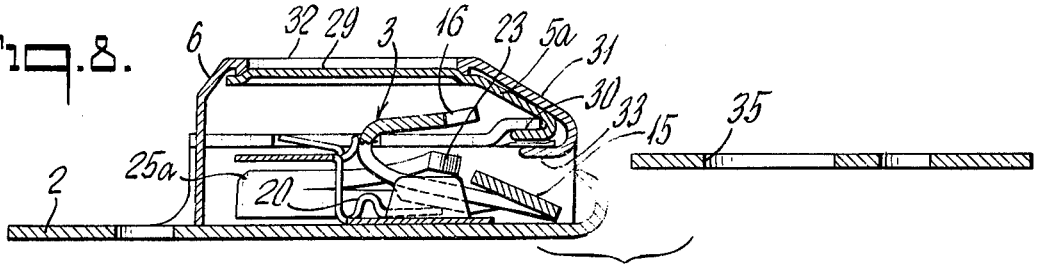
FIG. 8 is a medial longitudinal sectional view showing the tongue piece in a released position.
Figure 3:
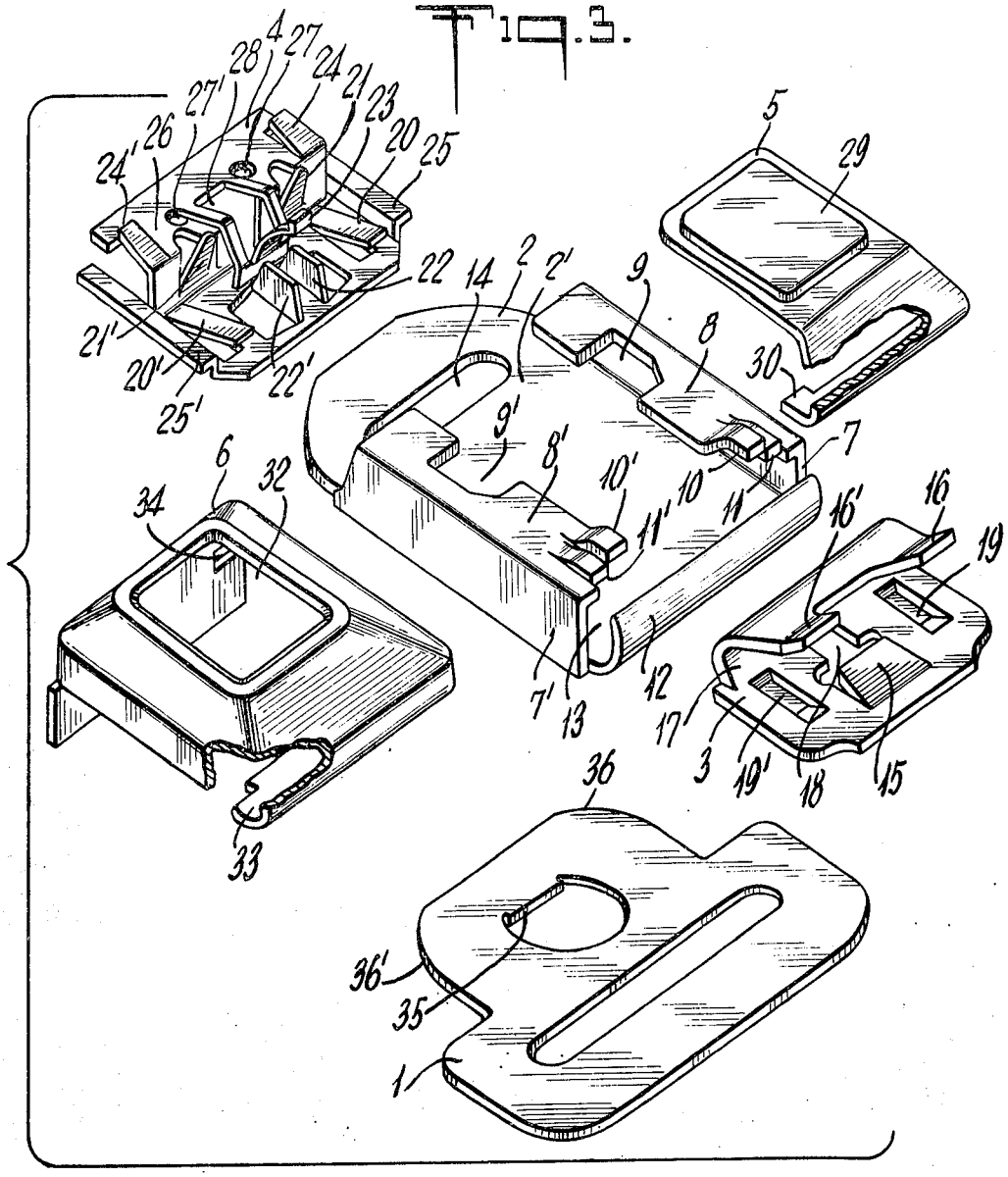
FIG. 3 is a perspective exploded view thereof.
Figure 6:
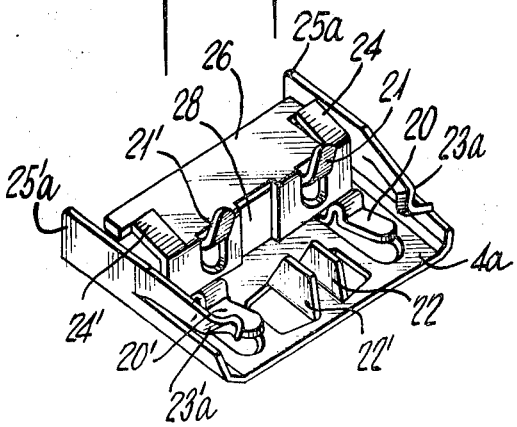
FIG. 6 is a perspective view of a modified spring member according to another embodiment of the present invention.
Figure 7:
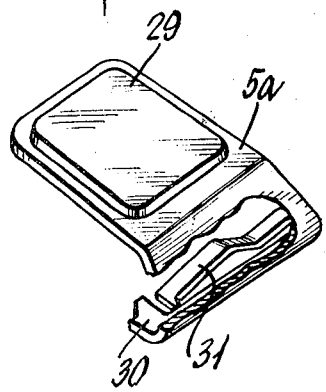
FIG. 7 is a perspective view of the actuating member thereof.

Referring now to FIGS. 6 to 8 which show another embodiment of the present invention, the tongue piece ejecting spring element 23 of the first described embodiment is provided at the vertical portion between the upper and the lower portions of the stepped thin spring plate member. In the present embodiment, on the other hand, a pair of tongue piece ejecting springs *23a, 23'a* are provided on the lower side walls *25a, 25'a* of the multi-function spring member *4a*. The ejecting springs *23a, 23'a* act to repel the tongue piece in a manner to pick up the cam surfaces 36, 36' of the tongue piece 1 as the latch plate 3 is lowered when the tongue piece 1 is being released, and at the same time, the tip of the springs *23a, 23'a* are positioned above the lower surface of the latch plate 3 to hold the latch plate 3 at a lowered position. The same symbols represent the same parts as those of FIG. 3. In connection with the modified multi-function spring member *4a*, a spring 31 is formed by cold pressing near the curved support point 30 of the push plate *5a*, in order that the push plate *5a* is pushed upward even when the latch plate 3 is held in its depressed position. That is, this is a state in which the buckle is being released as shown in FIG. 8. The tongue piece or ejecting springs *23a, 23'a* prevent the latch plate 3 from rising under the influence of the upwardly pressing springs 20, 20' that are positioned beneath the latch plate 3 and the spring 31 upwardly urges the push plate 5 to the window 32 of the cover 6 in relation to the tip of the curved engaging part 33 of the cover 6. Then, as the tongue piece is inserted, the springs *23a, 23'a* are spread sidewards by the inclined surface 36, 36' to permit the passage of the tongue piece, and frees the restriction to the latch plate 3 and the springs 20, 20' pushes up the latch plate 3 so that the tongue piece 1 is engaged by the latch plate 3. Also, when the tongue piece is inserted, the latch plate 3 will have been lowered down and held. Therefore, the force of inserting the tongue piece 1 may be so small as to only spread the springs 23*a*, 23'*a* sidewards. Accordingly, the aforementioned false latching never develops, and the tongue piece 1 is coupled. Next, to uncouple the tongue piece 1 from the buckle, the push part 29 is pressed so that the lower surface of the latch plate is lowered down causing the tongue piece to be freed, in the same manner as explained with reference to the first embodiment. The latch plate 3 at this moment, is lowered down and held as mentioned in the foregoing.

The coupling and uncoupling of the tongue piece with the buckle are effected as explained in the foregoing. Hence, the buckle may be fastened to one end of the seat belt and the tongue piece may be fastened to the other end of the belt, in order that the seat belt can be buckled and unbuckled.

As explained above, the buckle of the present invention is so constructed as to obviate false latching, and in which the spring plate is formed of a piece of thin plate, contributing to reduce the number of parts and to simplify the fastening operation. In addition, since the mechanism of engaging and disengaging the tongue piece is based on the latch plate that turns with the curved area as a fulcrum, the lever ratio can be increased in relation to the push plate, enabling to release the engagement with less pushing force. Moreover, the aforesaid multi-function spring member 4 applies forces to the latch plate in various directions such as forward, upward and inward directions, and in particular, the latch plate is loosely held by the spring which is pressing the latch plate forward, thereby improving touch feeling of inserting the tongue piece. Both the spring and latch members float in that they are not connected to the buckle frame. The buckle of the present invention reduces the number of parts, enhances simplicity in construction and assembling operation, and provides smooth engaging and disengaging operations, greatly contributing to have the passengers fasten the seat belt and to heighten the safety.

While there have been described and illustrated preferred embodiments of the present invention, it is apparent that numerous alterations, omissions and additions may be made without departing from the spirit thereof.

I claim:

1. A coupling device comprising a buckle including a hollow body member having a front opening and including longitudinally extending side walls provided with upper inwardly directed fulcrum sections, a coupling tongue longitudinally slidable through said front opening and having a first latching shoulder, a latching member housed in said body member and including upper and lower arm portions diverging forwardly from a knee portion engaging said fulcrum sections whereby said latch member is swingable between raised lock and depressed unlock positions, said latching member lower portion having a second shoulder movable with the swinging of said latch member between a lock position with said second shoulder engaging said first shoulder of the inserted tongue to releasably prevent the withdrawal thereof and an unlock position with said first and second shoulders out of registry and a unitary spring member disposed in said body member and including first spring elements resiliently urging said latching member to swing toward a predetermined lock position and a secnd spring element normally bearing on said tongue member when in fully inserted position to resiliently urge said tongue member toward a retracted position relative to said body member.

2. The coupling device of claim 1 wherein said spring member is in floating condition.

3. The coupling device of claim 2 wherein said body member includes a bottom base wall, said spring member includes a bottom base wall resting on said body member base wall and said latch member is disposed above said spring member base wall and is swingable about a transverse axis between its unlock position and its lock position.

4. The coupling device of claim 3 wherein said latch member lower portion comprises a base wall overlying said spring member base wall and having an opening formed therein and said spring member includes an upstanding guide leg slidably engaging said latch member base wall opening to permit said swinging movement of said latch member and restrict the lateral movement thereof.

5. The coupling device of claim 4 wherein said first spring elements includes spring elements engaging and biasing said latch member forwardly.

6. The coupling device of claim 1 including means locking said latch member in unlock position and responsive to the insertion of said coupling tongue to release said latch member locking means to free said latch member.

7. The coupling device of claim 1 wherein said first spring elements includes a first spring finger engaging said latch member knee portion to bias said latch member forwardly and another spring finger engaging said latch member lower portion under face to bias said latch member to its lock position.

8. The coupling device of claim 1 wherein said body member includes a top wall having a window therein and comprising an actuating member swingably supported by said body member and registering with said window and engaging said latch member upper portion.

9. A seat belt buckle for engaging a tongue piece (1), characterized in that side walls (7,7') are integrally formed to rise from both sides of a base plate (2'); upper parts of said side walls (7, 7') are bent inwardly to form flanges (8, 8'); one end of said base plate (2') is erected upwardly and inwardly to delineate a tongue insertion opening (13) with respect to said flanges (8, 8'); a push plate is mounted on the tongue piece insertion opening (13); both ends of bent portion (17) of a latch plate (3) of the shape of a hook in cross section having a tongue engaging part (15') at the bottom of the lower side and pressure receiving parts (16, 16') at the front end forming said hook, are latched to notched parts (9, 9') in said flanges (8, 8') of a frame (2) equipped with cover engaging parts (10, 10', 11, 11') and notched parts (9,9') at near the center thereof; the lower side of a multi-function spring (4) is inserted between said latch plate (3) and said base plate (2'), said multi-function spring (4) being made of a stepped and resilient thin plate having on the lower side springs (20, 20') to push up the latch plate and parts (22, 22') to press the latch plate sidewardly, engaging springs (24, 24') at the upper side, and at a middle stage a tongue piece ejecting spring (23) as well as springs (21, 21') to push the latch plate forwardly, in order that the latch plate (3) is resiliently held in various directions such as forward, upward and inward directions; a curved support point (30) is engaged with engaging parts (10, 10') of flanges (8, 8') of said frame (2) and a push plate (5) is provided to press the pressure receiving parts (16, 16') of the latch plate (3) in a manner that the upper surface of the pressure receiving parts (16, 16') of the latch plate (3) is covered; and the upper surface thereof is covered with a cover (6) except for push part (29).

* * * * *